United States Patent [19]

Kelem

[11] Patent Number: 4,642,865

[45] Date of Patent: Feb. 17, 1987

[54] METHOD AND APPARATUS FOR AUTOMATIC PRESSURE PACKING OF A FOOD CASING

[76] Inventor: Howard Kelem, 34-05 Ocean Ave., Oceanside, N.Y. 11572

[21] Appl. No.: 651,329

[22] Filed: Sep. 17, 1984

[51] Int. Cl.[4] ..... B65B 51/08

[52] U.S. Cl. ..... 29/243.56; 53/138 A

[58] Field of Search ..... 29/243.56, 243.57, 526 R; 53/138 A, 583, 417; 116/285, 303, 298; 221/6

[56] References Cited

U.S. PATENT DOCUMENTS

| | | | |
|---|---|---|---|
| 1,326,936 | 1/1920 | Jeans et al. | 221/6 X |
| 1,836,497 | 12/1931 | Phelps et al. | 29/243.56 X |
| 2,716,751 | 9/1955 | Kelem | 29/243.57 |
| 2,784,871 | 3/1957 | Gabrielsen | 221/6 |
| 3,524,242 | 8/1970 | Odean et al. | 29/243.57 |
| 4,182,015 | 1/1980 | Niedecker | 29/243.56 |
| 4,261,098 | 4/1981 | Lincoln | 29/243.56 X |

FOREIGN PATENT DOCUMENTS 2420315 10/1975 Fed. Rep. of Germany ... 53/138 A

*Primary Examiner*—Frederick R. Schmidt
*Assistant Examiner*—Steven P. Schad

[57] ABSTRACT

An automatic apparatus for pressure packing of a food casing including a yoke assembly for slidably receiving a neck portion of the casing. A rotating jaw assembly grasps a forward end of the casing and pulls the casing through the throat section by wrapping a forward portion of the casing about a cylindrical member constituting the jaw assembly. A feed mechanism feeds flat clips through a sequence of operating stations. At one of the operating stations a reciprocating forming die descends onto the flat clip and bends it into an inverted U-shaped clip. At another station, a reciprocating crimping die descends onto a bent clip and carries the bent clip into the throat section to crimp the shaped clip around the neck portion of the casing being retained in the throat section.

34 Claims, 19 Drawing Figures

METHOD AND APPARATUS FOR AUTOMATIC PRESSURE PACKING OF A FOOD CASING

BACKGROUND OF THE INVENTION

This invention relates to apparatus for pressure packing meat casings, and the like, and more particularly to an apparatus which packs the food tightly into the casing and then ties the casing by crimping a clip about the neck of the casing.

In the food industry, it is typical to pack food such as meat, cheese, and the like, in casings formed of cloth, plastic, and similar materials. After the food has been initially inserted into the casing, the casing must be sealed off. However, before such sealing, it is typical to pack the food tightly within the casing so that the food will remain solid and neatly packed for shipment and storage. The seal on the casing is usually a clip or other fastener which is banded or crimped about the neck portion of the casing after the food has been solidly packed into the casing.

Various machines have been available for both packing the food into the casing and then fastening the casing with a band around the neck portion. One such mechanism is described in my foregoing U.S. Pat. No. 2,716,751 issued on Sept. 6, 1955 for a Machine For Banding Meat Casings. In this device, the casing with the food in it is placed in a yoke assembly. The forward end of the casing is grasped between a pair of jaws and longitudinally pulled so that the neck of the casing passes through the yoke assembly with the food being retained behind the yoke assembly so as to be tightly packed within the casing. With the jaws still holding the forward end of the casing, an inverted U-shaped clip inserted into the throat of the yoke assembly is stapled in place by pulling down on a lever which closes the head portion of the yoke assembly fastening the clip about the neck of the casing.

In my U.S. Pat. No. 2,972,791, issued on Feb. 28, 1961 for a Casing Tie and Making Same, there is described an improved U-shaped metallic fastener for use in sealing the food casing and there is also described a feed mechanism for feeding the U-shaped fasteners horizontally into a throat area where it is compressed about a casing to fasten the. end of the casing.

In my U.S. Pat. No. 3,017,638, issued on Jan. 23, 1962 for Machine for Tieing Casings, there is also described an improved feeding mechanism for feeding the U-shaped metallic fasteners into a crimping device and subsequently inserting the fastener in place for crimping a body casing, finally indenting the fastener to an extent sufficient to effect a permanent seal about the casing.

While each of the foregoing patents describe improved apparatus for pressure packing of casings, they all require manual operation and accordingly do not provide high speed capabilities for pressure packing. Furthermore, they all utilize U-shaped clips either placed manually or automatically fed into a throat area and accordingly the initial distribution and dispensing of such preshaped U-shaped fasteners requires space and is cumbersome for easy shipping and storage. Additionally, the longitudinal grasping and pulling of the forward end of the casing in order to tightly pack the food into the casing, necessitates a long work area in order to adequately provide sufficient pull on the casing for such pressure packing.

Accordingly, while there presently exists apparatus for pressure packing of food into casings and sealing off the casings, there is a need for a fully automatic machine for effecting such operation which can bring about reduced costs and improved efficiencies.

SUMMARY OF THE INVENTION

Accordingly, it is an object of the present invention to provide a pressure packing apparatus which avoids the aforementioned problems of prior art devices.

Another object of the present invention is to provide a pressure packing apparatus which is automatic in order to improve efficiency and reduced costs.

Still another object of the present invention is to provide a pressure packing apparatus which is fed with flat clips and automatically shapes the clips prior to crimping about the neck portion of a food casing.

Still a further object of the present invention is to provide a pressure packing apparatus which tightly packs food into a casing by grasping the forward end of a casing and rotatingly wrapping the forward end of the casing about a spindle while restraining the food portion within the casing.

Another object of the present invention is to provide a pressure packing apparatus which automatically operates on a number of clips so as to bend one clip while crimping another clip about the neck portion of a casing.

Still a further object of the present invention is to provide a method of automatic pressure packing of a food casing.

Yet a further object of the present invention is to provide a stack of clips for use in an automatic apparatus for pressure packing of a food casing.

Briefly, in accordance with an embodiment of the present invention, there is provided an apparatus for automatic pressure packing of a food casing. The apparatus includes a yoke assembly having a throat section for slidably retaining therein a neck portion of the casing. A jaw assembly is also provided for grasping a forward end of the casing and pulling the casing through the throat section. The yoke assembly restrains the food behind the throat section to thereby tightly pack the food into the casing as the forward end is pulled. A feed mechanism continuously feeds flat clips through a sequence of operating stations. Among the operating stations there is provided both a forming station and a crimping station. At the forming station, a reciprocating forming die descends onto a flat clip and bends the clip into an inverted U-shaped form. At the crimping station, a reciprocating crimping die descends onto a bent clip and carries the clip into the throat section to crimp the clip about the casing neck portion which is being retained in the throat section.

In an embodiment of the invention, the jaw assembly includes a cylindrical member with a substantially diametrical channel formed across an upper end thereof. The forward end of the casing is received within the channel. The cylindrical member is rotatingly driven to wrap a forward portion of the casing about the cylindrical member thereby pulling the casing through the throat section.

The diametrical channel splits the upper portion of the cylindrical member into two sides. One side is fixed with respect to the cylindrical member while the other side is rotatingly floating with respect to the cylindrical member with the limits of rotation constricted by the width of the channel. The rotation of the cylindrical member itself causes the floating side to grasp the forward end of the casing and tightly restrain it against the fixed side of the casing.

The invention further contemplates a stack of flat clips for use in the automatic apparatus. The stack of clips includes a substantially flat elongated body portion with downwardly turned distal edges. At least two spaced apart elongated ribs are formed along the body portion. The stack of clips are sealed together in nested relationship with the seal being such as to permit a reciprocating feeding arm to sequentially feed individual clips from the stack into the pressure packing apparatus.

The aforementioned objects, features and advantages of the invention will, in part, be pointed out with particularity, and will, in part, become obvious from the following more detailed description of the invention, taken in conjunction with the accompanying drawings which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

General Description

Figure 1:
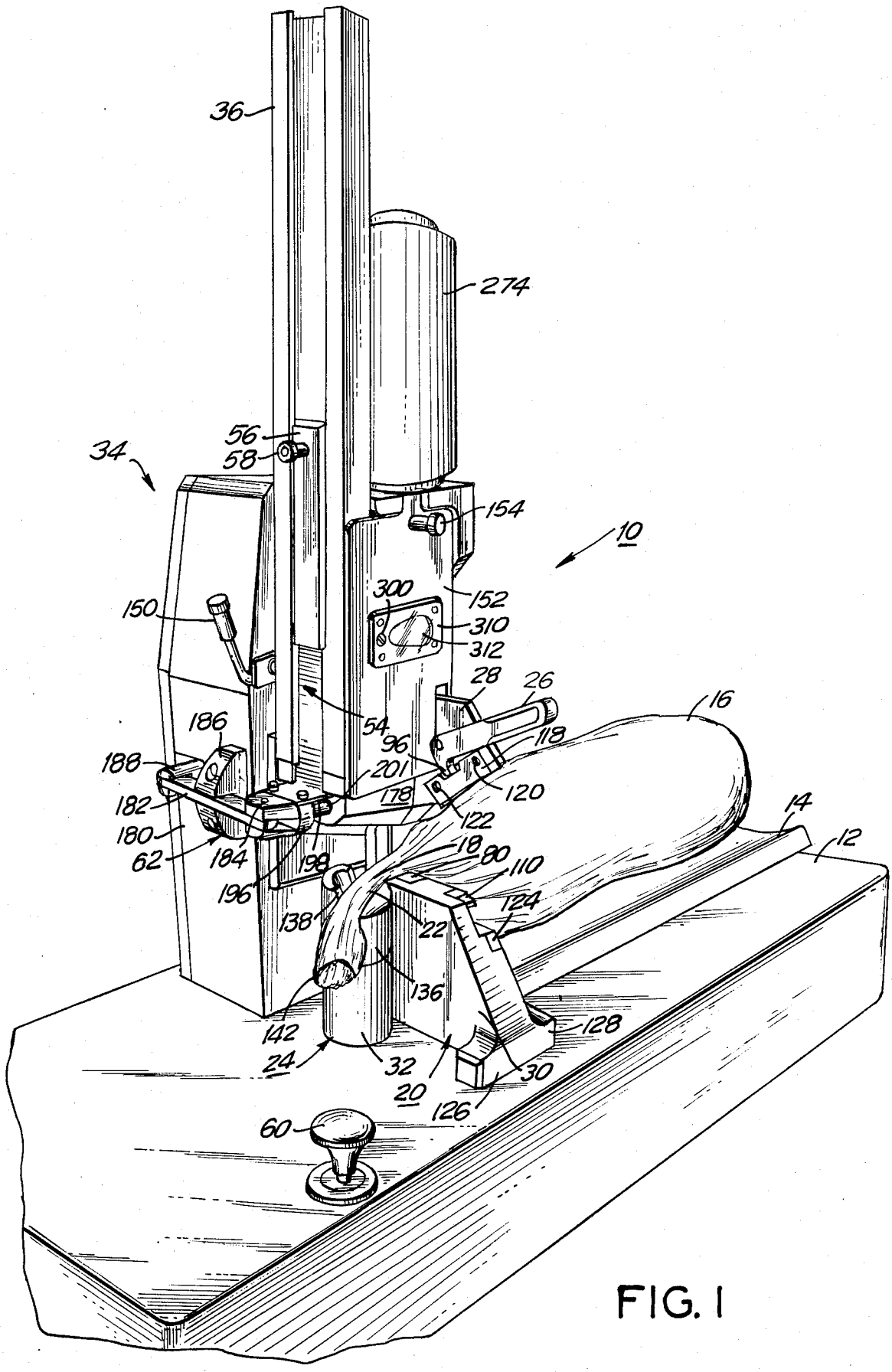
FIG. 1 is a perspective view of the apparatus of the present invention showing a food casing in place for pressure packing and fastening of the casing.

With reference now to FIG. 1, the automatic pressure packing machine of the present invention is shown generally at 10 and includes a substantially rectangular base 12 which supports a tray 14 on which a food casing 16 filled with food is placed. The tray 14 can be made removable from the base portion for easy cleaning, as is well known in the art. The tray 14 can be trough shaped so as to retain the food casing adequately positioned on the tray.

The food casing is placed in the mechanism with a forward neck portion thereof 18 extending through a yoke assembly, shown generally at 20. A forward end portion 22 of the food casing is placed within a jaw assembly shown generally at 24. By means of the handle 26 the head part 28 of the yoke assembly is closed onto the lower anvil part 30 so that the neck section 18 of the casing is slidably retained therein. Simultaneous with closure of the head portion 28, the jaw assembly 24 is activated so that the foward end portion 22 of the casing is wrapped around the cylindrical member 32 of the jaw assembly. In doing so, the neck portion 18, of the casing, is pulled through the throat of the yoke assembly 20. However, the food contained within the casing 16 is prevented from passing through the throat by means of the yoke assembly. As a result, the food is tightly packed within the casing.

Upstandingly supported on the base member 12 is a clipping mechanism 34 which crimps a clip around the neck portion 18 of the casing 16, while the neck portion is retained in the throat. The clipping mechanism 34 includes a chute 36 which receives flat staples, of the type shown in FIG. 10. As shown, each staple 38 is substantially flat having an elongated shape including a central body portion 40 and lateral end portions 42, 44. The distal edges of the lateral portions are downwardly turned at 46 and 48. The lateral sections 42, 44 are convergingly tapered toward their lateral edges 46, 48. A pair of spaced apart upstanding elongated ribs 50, 52 are formed on the body portion 40 for providing rigidity and support. The clips can be prepackaged into a group, shown generally at 54, with the use of a transparent glue or sealing material 56 to hold the individual flat clips 38 secured together in nested relationship. The type of glue or sealing material is similar to that used in stapling apparatus whereby although the clips are initially retained together for storage, transport, and loading into the chute of the apparatus, they can be easily separated for the individual injection into the apparatus.

As shown in FIG. 1, the clips in prepackaged arrangement 54 are loaded into the chute and are retained in place by means of a weight 56 movable by means of a handle 58 extending outwardly from the chute.

Upon operation of a knob 60, upwardly extending from the base 12, the reciprocating feeding mechanism, shown generally at 62, will inject a clip from the package of clips 54 contained in the chute 36 and move it along an operating platform as will hereinafter be described. Each flat clip moves sequentially until it reaches a forming station at which time the flat clip will be bent into a substantially inverted U-shaped configuration. The bent clip will then be sequentially moved to a crimping station at which time a reciprocating crimping die descends onto the bent clip and carries the bent clip downward into the throat section of the yoke assembly 20 where the bent clip will be crimped about the neck portion of the casing 16.

Following crimping the reciprocating crimping die moves upwardly bringing with it the bending die and permitting the next clip to be injected and moved sequentially in place for a subsequent operation. Automatically, the jaw assembly 24 will unwind, releasing the forward end 22 of the casing. The handle 26 can be raised to lift the head portion 28 from the anvil 30 and the casing 16 which is now banded by having a clip crimped about its neck portion, can be removed.

Although the apparatus is shown for use in connection with packaging and closing off a casing in which food has already been inserted, it should be understood that when a sleeve type casing is utilized, the rear end of the casing can also be closed off by means of a clip crimped around the rear end even though no food is contained yet in the casing. The casing can then be filled and the front end again sealed off by means of a clip crimped around the neck portion. In this way both forward and rear ends of the casing sleeve are closed off by means of clips crimped around the ends thereof.

The entire operation of the apparatus is achieved by means of air cylinder operation triggered by reciprocating movements of the various parts. As a result, after intial placement of the casing and closure of the yoke assembly, the operation of the jaw assembly to pack the food into the casing will be automatically achieved. Similarly, single operation of the control knob 60 causes the complete automatic operation of both the bending of the clips and the crimping of the clips around the neck portion. Accordingly, the entire operation is automatic providing crimped clips from a supply of flat clips initially placed in a feeding chute.

Figure 5:
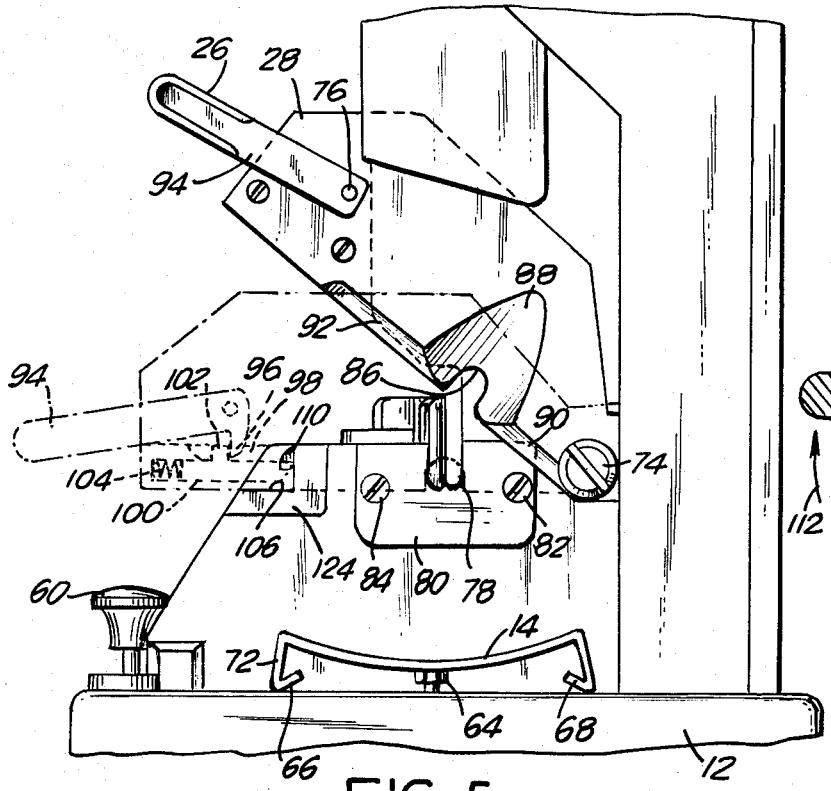
FIG. 5 is a side elevational view of the yoke assembly showing the operation of the head portion with respect to the anvil portion.

As shown in FIG. 5, the tray 14 situated on the base 12 can be removably positioned by means of knobs 64 sliding in elongated slots. The tray itself can have inwardly turned lower ends 66, 68 extending from downwardly directed arms 70, 72 for facilitating the handling of the tray.

Yoke Assembly

Figure 3:
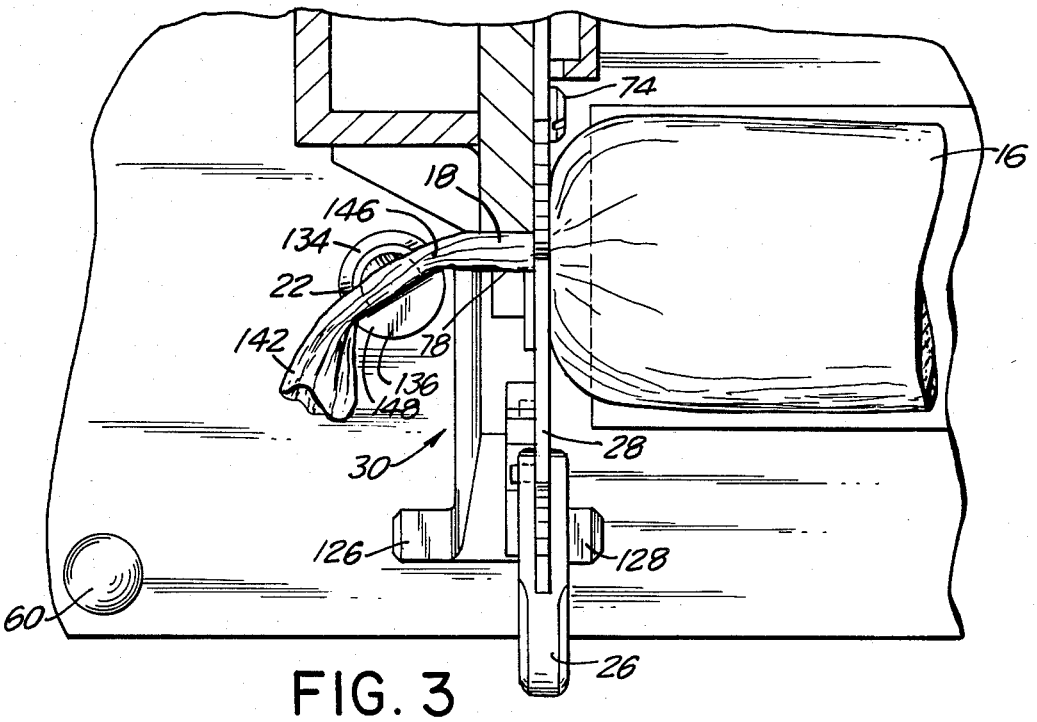
FIG. 3 is a partial top view taken through the feeding apparatus so as to look down on the yoke assembly holding the food casing and the jaw assembly grasping a forward end of the casing.
Figure 5A:
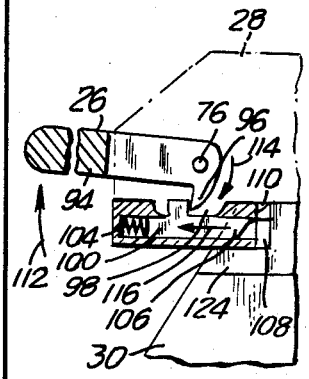
FIG. 5A is a partially broken away view of the forward handle of the head portion shown in FIG. 5 and showing the operation of the latching mechanism of the head portion with the anvil portion.

The yoke assembly shown generally at 20 can best be seen in more detail with reference to FIGS. 3, 5 and 5A. The yoke assembly includes the fixed lower anvil portion 30 and the upper head portion 28 which is pivotally assocated with the fixed anvil portion by means of the pivot screw 74 extending through the head portion and into the anvil portion. The handle 26 axially extends from the head portion and is pivotted thereon by means of the pivot pin 76. A substantially U-shaped throat section 78 is defined in the anvil portion. For extra support, a steel reinforcing plate 80 is secured by means of the screws 82, 84 into the yoke member about the throat section 78 to provide longer wear of the throat section. A corresponding U-shaped throat section 86 is formed in the head portion 28 of the yoke assembly which cooperates with the lower throat section 78 to define a substantially circular throat through which the neck portion of the casing can be inserted. A concave cutout back wall 88 is formed above the throat section 86 in the head portion and likewise a beveled lower edge 90, 92 on either side of the throat section 86, helps to define the throat section and direct the neck portion of the casing into the throat. By means of the cut out and beveled sections formed around the throat section 86, any upper portion of the neck portion of the casing extending above the lower throat section 78 will be collected and directed into the throat section. It should be appreciated, that the throat section does not tightly clamp the neck portion. It only retains the neck portion which can slidably pass therethrough and serves to restrain the food contained within the casing from passing beyond the yoke assembly as the casing is pulled through the neck portion.

Movement of the handle operates a latching mechanism as best shown in FIGS. 5 and 5A. Specifically, the handle includes a substantially elongated lever 94 terminating in a downwardly directed finger 96 which is received within a notch 98 of a spring loaded plunger 100. The finger 96 engages the shoulder portion 102 of the plunger 100 to push it against the spring 104. The forward end of the plunger 100 includes the nose portion 106 which fits into the recess 108 and engages beneath the catch 110.

In its normal position, as shown in the dotted lines in FIG. 5, the nose 106 is engaged beneath the catch 110 to lock the head portion 28 in place on the anvil 30. When the handle 26 is lifted as shown by the arrow 112 in FIG. 5A, the finger 96 moves downwardly as shown by the arrow 114 so as to move the plunger 100 in the direction shown by the arrow 116 thereby releasing the nose 106 from engagement beneath the catch 110 so as to permit lifting of the head portion 28 from the anvil 30.

Because of the spring mechanism, as soon as the head portion is lowered, the plunger will automatically be spring loaded to engage the nose portion 106 beneath the catch 110 to lock the head portion 28 in place on the anvil 30.

As best noted in FIG. 3, the width of the anvil portion 30, is wider than the width of the head portion 28. As a result, a portion of the inverted U-shaped throat section 78 contained in the anvil portion 30 is exposed and permits placement of the clip therein for crimping of the clip around the neck portion. Thus, while the head portion 28 of the yoke assembly retains the neck portion in place, it only holds a small part of the neck portion while permitting the remainder to be exposed for crimping of the clip thereabout in the lower portion 78 of the throat section.

The latching mechanism is retained within an enclosed housing 118 secured onto the head portion 28 of the yoke assembly by means of screws 120, 122 as best seen in FIG. 1. This portion can be made out of steel for durability. Similarly, the engaging latching portions 110 and recess 108 can be formed within a steel section 124 secured onto the anvil portion. The anvil itself can be securedly retained onto the base 12 of the apparatus by means of the laterally extending legs 126, 128 on the bottom thereof for secured retention.

Jaw Assembly

Figure 2:
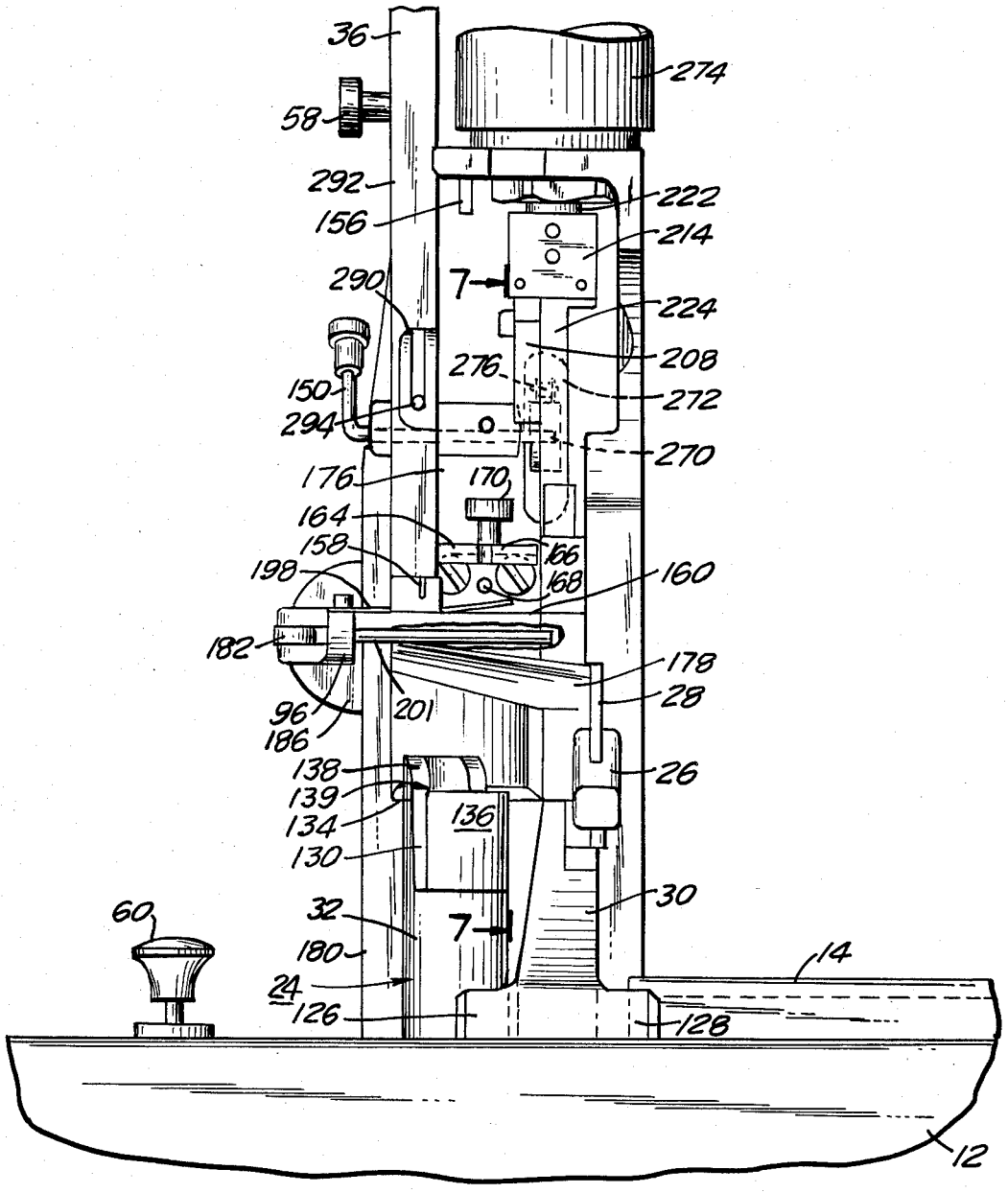
FIG. 2 is a partial elevational view with the front plate removed so as to expose the operational parts of the apparatus.
Figure 3A:
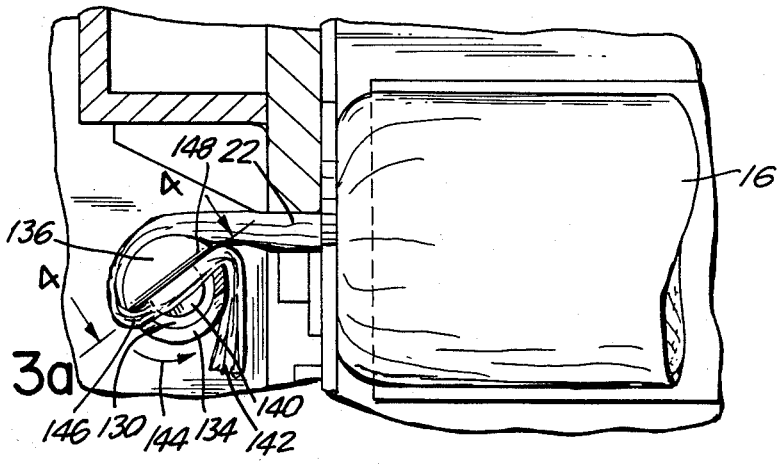
FIG. 3A is a view similar to that shown in FIG. 3 and focusing in on the operation of the jaw assembly after rotating so as to grasp and pull the forward end of the casing through the yoke assembly.
Figure 4:
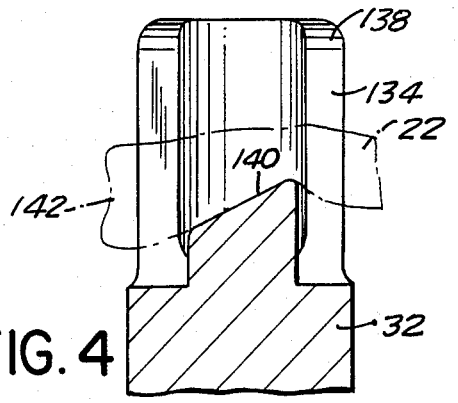
FIG. 4 is a cross sectional view taken along lines 4—4 of FIG. 3A and showing the internal structure of the jaw assembly.

The rotating jaw assembly shown at 24 in FIG. 1, can best be seen in FIGS. 3, 3A, 4 as well as FIG. 2. The jaw assembly includes a substantially cylindrical member 32 which is reciprocatingly controlled to oscillate, as will hereinafter be described. The top of the cylindrical member 32 has a substantially diametrical channel 130 formed therethrough which bifurcates the upper half of the cylindrical member 32. The channel divides the upper half of the cylindrical member into two sections. A first section 134 is fixed to the lower portion, and forms a rim at its upper section, the center thereof being substantially cut away. The other half of the upper section 136 is substantially solid and includes a lower portion which extends into a recess provided into the bottom half 32 of the cylindrical member. The width of the channel 130 is wide enough to accommodate passage therein of the forward end 22 of the casing. In order to facilitate insertion of the forward end 22 of the casing, the upper end of the mouth of the channel is flared outwardly to define an angled surface 138 on the fixed portion of the upper half, as well as an angled portion on the upper half of the rotating portion 136. The rotating portion 136 is free floating with respect to the fixed portion 134 and is limited in rotational movement by the width of the channel. The fixed portion 134 extends upwardly to a slightly greater height than the free floating portion 136 to again facilitate receiving therein of the forward end portion 22 of the casing. Although the inner portion of the fixed section 134 is substantially cut out so as to leave out only a peripheral rim of the section 134, at the base of the fixed section 134, the lower portion 32 of the cylinder does extend upwardly and terminates in an angled upper surface 140. This again facilitates insertion of the neck portion 22 of the casing, as shown in FIG. 4. Specifically as the neck portion 22 is inserted into the mouth of the channel, and pressed downwardly, the front distal end 142 of the casing can be pulled downwardly following the direction of the downwardly directed surface 140 at the bottom of the fixed section 134. The jaw assembly operates as follows.

The forward end 22 of the casing 16 is inserted through the channel with the forward distal end 142 extending beyond the channel. The cylindrical member 32 is then caused to rotate. Rotation is in a counter clockwise direction, as shown by the arrow 144 in FIG. 3A. As a result, as shown in FIG. 3, the initial rotation is in a direction so as to cause the trailing end 146 of the front part of the casing to initially wrap around the free floating portion 136 of the top of the jaw assembly. Because of the restraint on the casing as the jaw assembly begins to rotate, the rotation forces the forward edge 148 of the free floating portion 136 to rotate inwardly toward the fixed portion 134 so as to inherently clamp the casing portion 22 contained in the channel at that point. Accordingly, although the casing is simply inserted into the channel without grasping, clamping, or in other ways tightly retaining that portion of the casing, the rotation of the cylindrical member will initially grasp the casing by means of the free floating portion rotating within the limits of the channel to grasp the casing between itself and the fixed portion of the cylindrical member.

Continuous rotation of the cylindrical member causes the casing to wrap around the cylindrical member, as shown in FIG. 3A. The wrapping causes the casing to be pulled through the throat of the yoke assembly as more casing is continuously wrapped about the cylindrical member. The food contained within the casing, however, is restrained from passing through the throat portion because of the narrow size of the throat portion at the yoke assembly. As a result, the food is pressure packed within the casing.

It should be appreciated, that the use of the cylindrical member for pulling the casing avoids the necessity of having a large elongated area for pulling of the casing. Normally, when the forward end of the casing is grasped, and pulled longitudinally, a large space is required for such longitudinal pulling. Furthermore, the casing must be grasped by means of jaws prior to the pulling. With the present cylindrical arrangement, there is no required step of grasping. The grasping will be automatic as the free portion is pressed toward the fixed portion of the cylindrical member with the cylindrical member commencing its turning. Furthermore, because the cylindrical member wraps the casing therearound, little area is needed and yet the benefit of pulling the casing is achieved.

As will hereinafter be explained, after the clip has been crimped around the neck portion of the casing, the jaw is rotated in the opposite direction to unwrap the casing permitting lifting of the casing out of the channel for removal of the casing from the apparatus. The rotating of the jaw assembly to wrap the casing is achieved automatically upon closure of the head portion of the yoke assembly, as will hereinafter be explained. The unwinding of the cylinder also occurs automatically at the conclusion of the final up stroke of the crimping die, as will also be hereinafter explained. In addition, as shown in FIG. 1, there is provided a separate release lever 150 which can release the jaw assembly, unwinding it for removal of the casing. Thus, should a casing have been inserted and pressure packed, and should the entire cycle not be completed, for whatever reason, the release lever 150 can be operated to unwind the jaw assembly thereby permitting removal of the casing. This provides an extra safety feature, as will hereinafter be explained.

Crimping Mechanism

The crimping mechanism, shown generally at 34 in FIG. 1 can best be seen in FIGS. 2, 6A–6D and 7–7C. The operative sections of the crimping mechanism are covered by means of a front plate 152, best shown in FIG. 1. The front plate is removed by means of a knob 154 at the upper portion thereof. The front plate itself is retained in place by means of tension clips placed on the inside of the plate and snapping onto the pins 156 and 158, as shown in FIG. 2.

Upon removal of the front plate 152, the operating platform 160 is exposed. It is along this platform 160 that the flat clips will be fed and moved to a sequence of steps, as will hereinafter be explained. The clips move in sequence along the platform and are securely retained in place by means of an upwardly extending leaf spring 162 projecting along the surface of the platform 160. A top cover plate 164 is wedged in spaced relationship above the platform 160 so that the clips moving along the platform are retained in place between the spring 162 and the lower surface 166 of the top cover plate 164. Sufficient space is provided to permit passage of the thickness of a clip therealong and retain the clips tight by means of the spring force of the spring member 162.

The top cover plate 164 is shown in FIG. 2 to be raised above the surface 160 for viewing of the spring 162. However, it should be appreciated that in normal operation it will be directly above the spring 162. The cover plate 164 is held in place by wedging it beneath the pin 168 which is received in a recess in the plate 164. A knob 170 is provided at the top of the cover plate for removal of the cover plate from its retained position above the platform 160.

The platform 160 is retained within a chamber 176 formed within the housing 178. The front of the housing being closed off by means of the front plate 152. The housing 178 is supported by means of the upstanding frame 180 supported on the base 12 and in which is provided the cylinders, valves, etc. as will hereinafter be explained.

The clip feeding mechanism, shown generally at 62 includes a reciprocating arm 182 centrally pivoted by the pivot pin 184 passing through the yoke member 186 secured onto the upstanding housing 180. The rear end of the arm 182 is secured onto a linkage mechanism 188 by means of a pin 190. The forward end is pinned to a blade assembly 192 through the pin 194. As shown in FIG. 1, the blade assembly includes a retaining collar 196 to which is connected an upper blade 198. The blade 198 is positioned to engage the lower end of the chute 36 so as to reciprocatingly inject individual ones of the flat clips from the front end of the chute and inject them onto the platform 160. Two rods 201, 203, as best seen in FIGS. 1, 2 & 6B extend into bores provided in the housing 178 for advancing a bent clip into the crimping station, as will hereinafter be explained.

Figure 6A:
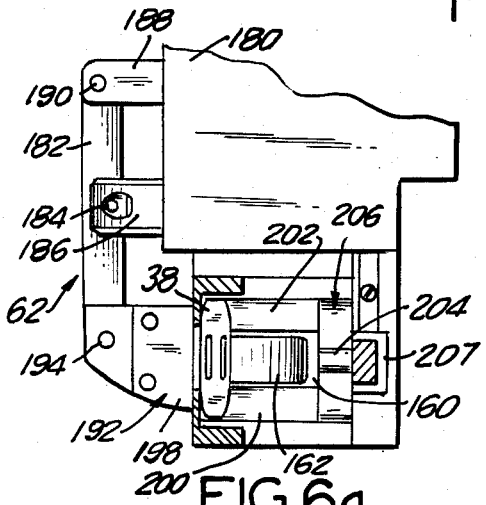
FIGS. 6A, 6B, and 6C are partially sectioned plan views of the feeding mechanism sequentially feeding clips along the platform for operation at a sequence of stations including a forming station and a crimping station.
Figure 6B:
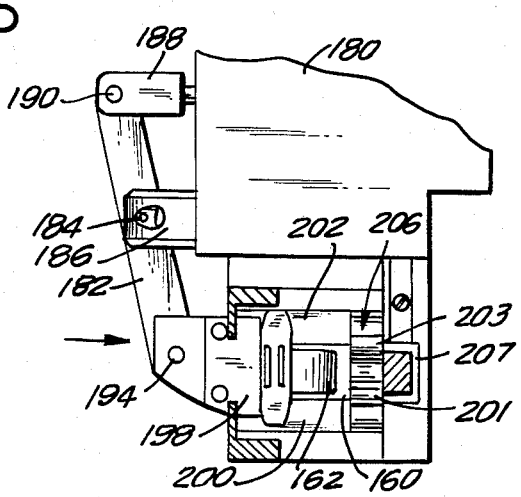
Figure 6C:
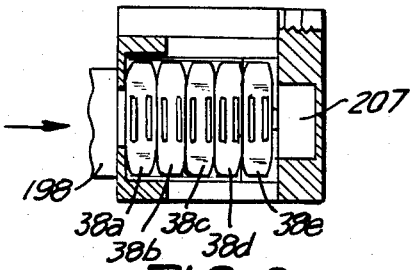

As best shown in FIGS. 6A–6C, the feeding mechanism operates so as to retract the blade 198 from beneath the chute. It then moves forward, as shown in FIG. 6B injecting a clip from the chute onto the platform. As shown in FIG. 6C, each of the clip sequentially move previously injected clips along the platform to form assembly lines of the clips along the platform.

Figure 6D:
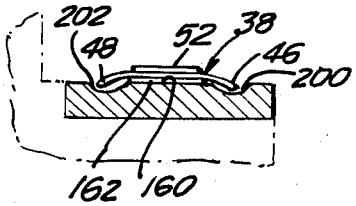
FIG. 6D is an end view of the operating platform upon which the flat clips are fed.

As shown in FIG. 6D, the shape of the platform 160 includes a flattened center section and lateral elongated grooves 200 and 202. These grooves accommodate the downwardly turned distal ends 46, 48 of the clips 38. Accordingly, the upwardly directed spring 162 only extends along the central portion of the platform 160 so as not to interfere with the downwardly turned distal ends of the clip.

As shown in FIGS. 6A–6C, the continuous reciprocating operation of the feed mechanism causes a series of clips to be fed along the surface of the operating platform. The operating platform is of a length so as to accommodate four clips designated as 38A, 38B, 38C, and 38D. The fifth clip, 38E is shown to be moved off the forward end of the platform so as to sit onto the head 204 of a lower portion of a bending die set. The head portion 204 is positioned at a forming station 206, to be described hereinafter. At the station 206, the flat clip 38E will be bent, as will hereinafter be described. Subsequently, that bent clip will be pushed forward by the rods 201, 203, into the crimping station 206, as also will hereinafter be described.

Figure 7:
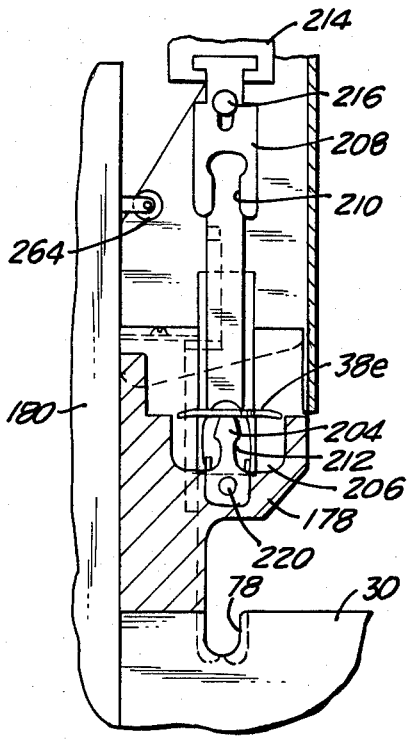
FIGS. 7, 7A, 7B and 7C show partially sectioned elevational views at sequential sections along the operating platform with FIG. 7 showing a flat clip in position at the forming station, FIG. 7A showing the descent of the forming die so as to shape the flat clip into an inverted U-shaped clip, FIG. 7B showing the location of a bent clip in the reciprocating crimping die and FIG. 7C showing the crimping of the bent clip about the neck of the casing retained in the throat section of the yoke assembly.
Figure 7A:
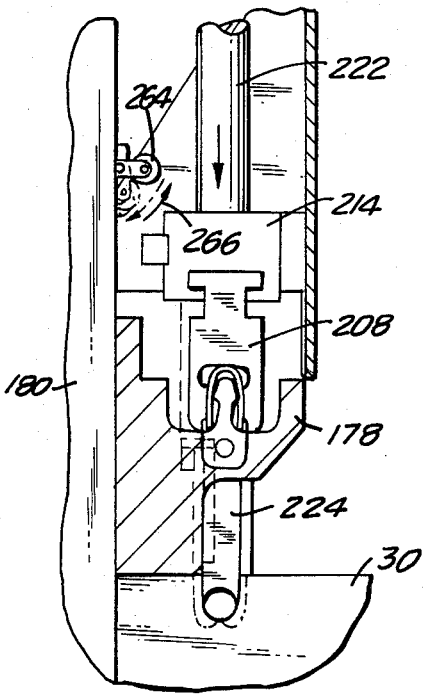
Figure 7B:
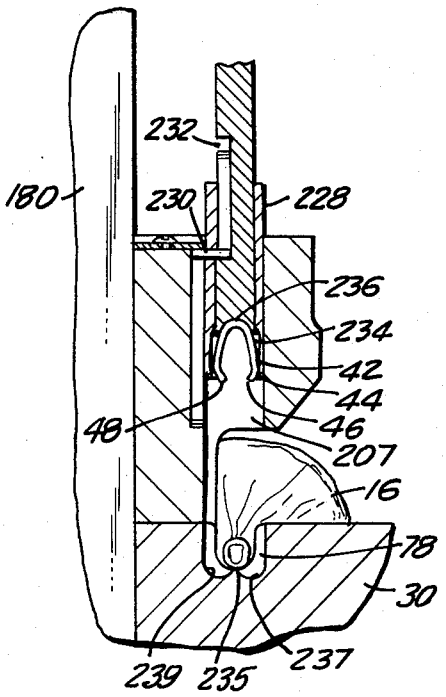
Figure 7C:
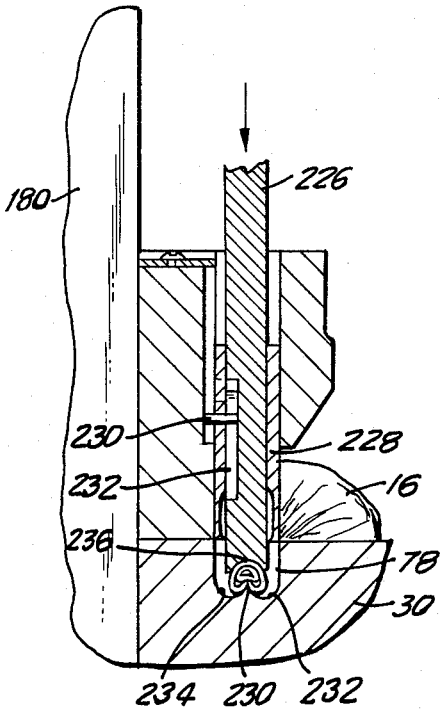

Referring now to FIGS. 7–7C, the sequence of operations at the forming and crimping stations will now be described.

The upper portion of the forming die 208 includes a substantially U-shaped forming chamber 210 which matingly receives therein the projecting lower die member 212 including the head portion 204. The upper forming die 208 is secured onto a reciprocating head 214 by means of a pin 216. The lower die 212 is secured into the housing 178 by means of the pin 220. As the clip 38E reaches the forming station 206, the upper forming die 208 descends downwardly so that the chamber 210 engages onto the lower forming die 212 bending the clip 38E in a substantially inverted U-shaped arrangement, as shown in FIGS. 7A. The forming die 208 is driven downwardly by the driving ram 222 which operates the reciprocating head portion 214.

Also connected to the reciprocating head 214 is the crimping die 224. As best seen in FIGS. 7A–7C, the crimping die includes an internal rod member 226 surrounded by a substantially U-shaped sleeve 228 on three sides thereof. The sleeve is axially slidable along the rod 226 by means of an inwardly directed pin 230 extending from the sleeve which can ride within a channel 232 formed in the rod 226.

Initially, the sleeve 228 extends downwardly beyond the forward end of the rod 226 so as to define a crimping die chamber 234 . After the clip is bent at the forming station, the next injection of a new clip by the reciprocating injector 62, causes the rods 201, 203, as shown in FIG. 6B, to push the bent clip into the crimping die. When the clip is bent, the lateral side portions 42, 44 are outwardly flared so as to be spring held within the crimping die chamber 234 defined by the extending sleeve 228. The bent clip will remain in this chamber until the next reciprocating stroke.

At the next stroke, the reciprocating head 214 is moved downwardly by means of the reciprocating ram 222. As the forming die comes down to bend one clip positioned in the forming station, the crimping die will also descend to crimp the clip positioned in the chamber 234.

Specifically, as shown in FIGS. 7B and 7C, both the rod 226 and the sleeve 228 will descend downwardly through the crimping station 207. As it moves downwardly, it reaches the throat section 78. As pointed out heretofore, the anvil portion 30 of the yoke assembly is wider than the head portion. As a result, the crimping die will descend into the portion of the anvil adjacent to the head portion of the yoke assembly.

The rod 226 and the sleeve 228 continue descending bringing the bent clip 224 downward with it. As the sleeve reaches the perimeter of the throat 78 in the anvil 30, the sleeve is retained at the mouth on the surface of the anvil and prevented from entering into the throat. However, the rod 226 continues to move downwardly passing through the sleeve. The pin 230 rides within the channel 232 permitting the rod 226 to descend within the sleeve and carrying the bent clip into the throat 78. As shown in FIGS. 7B and 7C, the lower end of the throat section is shaped as a "w". Specifically, there is an upwardly directed projection 235 at the bottom of the throat section with the arcuately curved sections 237, 239 at either side thereof. As the clip is brought into the throat section, the forward end of the clips are directed by means of the arcuate sections 237, 239 and the center projection 235 into a crimped arrangement around the neck of the casing which is retained in the throat.

Figure 10:
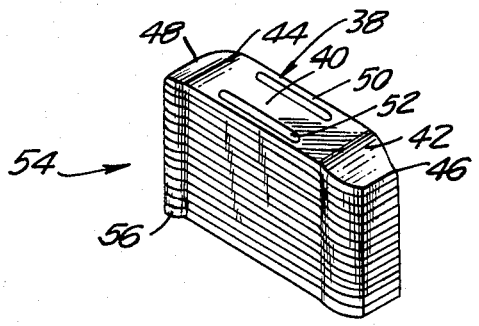
FIG. 10 is a perspective view of a package of flat clips for insertion in the chute of the pressure packing apparatus.

It should be recalled, as was pointed out in FIG. 10, that the distal ends of the clips are downwardly directed at 46, 48. For this reason, the grooves 200 and 202 were provided in the platform along which the clips pass. The reason for the downwardly directed distal ends 46, 48 are that when the clip is bent as shown in FIG. 7, these distal ends 46, 48 will now be inwardly turned. This will facilitate the crimping of the side walls of the clip as they are directed along the arcuate sections 237, 239 in the throat 78.

It should be noted, that both the bending die and the crimping die operate by means of the same reciprocating head 214. As a result, while one clip is being bent at the forming station, the previously bent clip can now be crimped at the crimping station. This facilitates automatic operation in a continuous manner so that there is always a sequence of clips available for bending and crimping as the casings are inserted into the throat section of the yoke assembly.

After a crimping operation has been completed, the reciprocating head 214 moves upwardly first bringing the rod 226 out of the throat. As the pin 230 hits the upper end of the channel 232, it then grasps the sleeve and pulls the sleeve up with it. Simultaneous with the upward movement of the crimping die, the forming die will also move upwardly. Both dies will now be out of the way permitting the injection of the next clip along the platform which pushes previously placed clips along the platform and inserting a new clip in place for further bending and a last bent clip now within the receiving chamber 234 for subsequent crimping.

In order to facilitate the downward movement of the clip into the chamber, the forward end of the ram 226 is arcuately curved at 236 so as to be able to accommodate the bight portion of the clip and push it downward into the throat.

Operation

Figure 8:
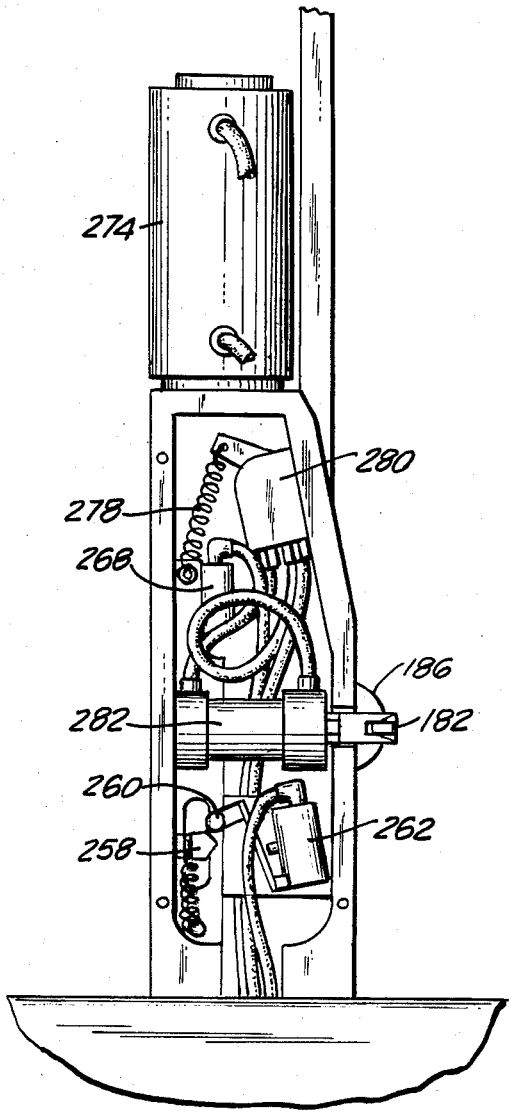
FIG. 8 is a rear elevational view of the operating mechanism and showing the various valves and cylinders for operating the feeding, bending, and crimping operations.
Figure 9:
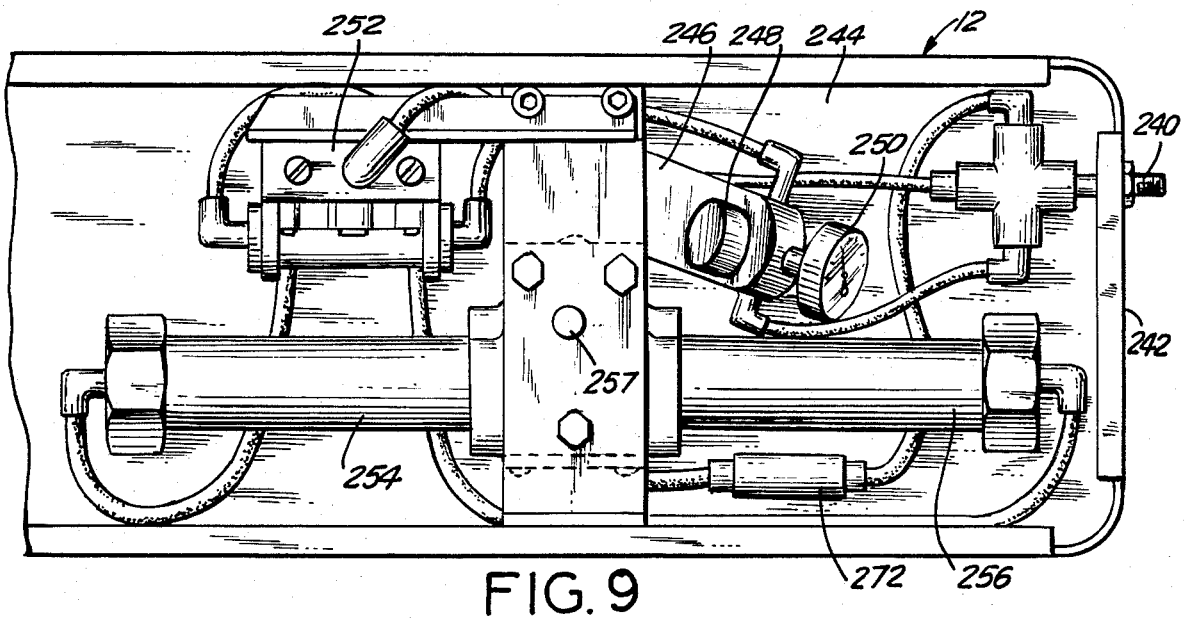
FIG. 9 is a bottom plan view showing the cylinders, valves and switches for operation of the jaw assembly and input and control of the air pressure to the apparatus.

The operation of the apparatus can best be understood with respect to FIGS. 8 and 9, and with reference to specific other figures as will hereinafter be pointed out.

Air for operating the cylinders is connected through the nipple 240 extending from a side 242 of the base 12. Contained within the base is a chamber 244 including a pressure control valve 246 with an adjusting knob 248 and a meter 250 for regulating the amount of pressure being applied to the system.

The air pressure is sent through a pilot valve 252 which controls the flow of air pressure to a pair of reciproeating cylinders 254, 256. These operate the shaft 257 which is connected to the cylindrical member 32 of the rotating jaws. When the head portion of the yoke assembly is lowered, it is connected to the lever arm 258, shown in FIG. 8, which triggers the arm 260 so as to operate the switch 262 thereby causing one of the rotating cylinders 254, 256 to rotate the cylindrical member of the jaw assembly wrapping the front portion of the casing about the cylindrical member.

At the conclusion of the upward stroke of the crimping die, a switch 264 is hit, as shown in FIGS. 7 and 7A. This switch rotates as shown by the arrows 266 in FIG. 7A. This switch will then trigger the valve 268, shown in FIG. 8 so as to cause the other of the cylinders 254, 256 to rotate the cylindrical jaw in the opposite direction, thereby releasing the casing.

As was heretofore mentioned in FIG. 2, there is provided a safety release valve 150 having an extending arm 270 which operates within an elongated oval 272. This arm likewise can serve to trigger the valve 268 so as to release the jaws even though the crimping action has not proceeded.

After the jaws have rotated to wrap the casing about the cylindrical member, the button 60 is hit. This will operate the valve 272, as shown at the bottom of FIG. 9. Closing of this valve causes the cylinder 274 at the top of the device to begin operation of the ram 222 descending the forming and crimping dies. These dies first move downwardly to bend one clip while crimping the other clip. As the reciprocating head 214 moves downwardly, it first hits a projecting switch 276 (as best shown in FIG. 2) which operates the spring 278 shown in FIG. 8 causing the air valve 280 to send air to the cylinder 282 thereby retracting the blade from the reciprocating mechanism. The crimping and forming will then proceed.

At the conclusion of the crimping and forming operation, as the reciprocating arm moves upwardly, it will permit the switch 276 to open thereby releasing the air from the cylinder 282 so as to cause the blade to inject a new clip along the platform sequentially pushing the previously injected clips along the platform into a forming and bending position as well as a bent clip into a crimping position for further operation Accordingly, the sequence of operations are as follows: A packed casing is placed on the tray and the neck portion inserted into the lower part of the throat in the yoke assembly. The handle of the yoke assembly pulls down the head portion of the yoke assembly so as to clamp the neck portion of the casing within the throat. With the bringing down of the head portion, the head portion locks in place on the anvil portion of the yoke assembly. The forward end of the casing is inserted in the channel of the jaw assembly prior to closure of the head portion.

With closure of the head portion, the jaw assembly is caused to rotate thereby wrapping the forward portion of the casing about the cylindrical jaw assembly and pressure packing the food into the casing.

The button 60 is then depressed. This causes initially the reciprocating head to begin its downward movement. With initial downward movement, a trigger is hit causing the retracting arm to retract and remain in its retracted position. The descending reciprocating head then brings down the forming die to bend one flat clip previously positioned over the lower bending die in the forming station. It also causes the crimping die to carry down a previously inserted bent clip. The crimping die moves downwardly and continues until the sleeve portion of the crimping die is held at the mouth of the throat. The central rod of the crimping die then moves and carries the bent clip into the throat portion crimping the clip about the neck portion of the casing.

The reciprocating ram then begins its upward movement. It then pulls the rod from the throat and brings along the sleeve with it. Both the crimping and forming die move upwardly. It then hits one switch causing the rotating jaws to unwind thereby releasing the forward end of the casing. It then hits the switch controlling the feeding mechanism causing the retracting arm of the feeding mechanism to move inwardly injecting a subsequent clip along the platform thereby pushing foward all of the previously injected clips, placing a new clip into a forming station for further bending and pushing the previously bent clip into the crimping die chamber in the crimping die. The apparatus is then already initialized and ready for the next insertion of the new casing.

In order to initialize the entire apparatus, it is noted that four clips must be placed along the platform and the fifth clip is then in position for bending. Accordingly, five initial depressions of the button 60 are required before the first casing can be placed in the yoke assembly. Of course, it should be appreciated, that the length of the platform can be varied to modify this initializing operation.

Indicator Mechanism

Figure 11:
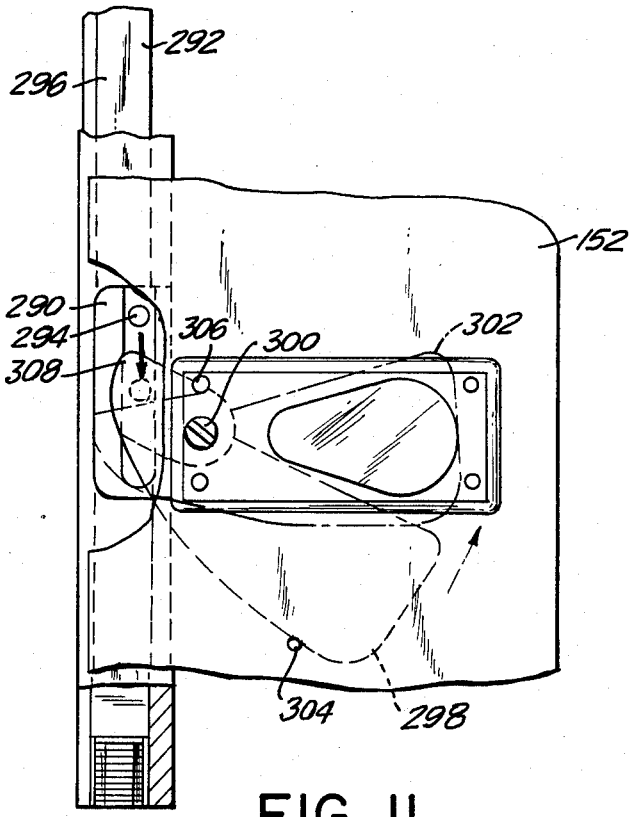
FIG. 11 is an exploded partially sectioned elevational view of the front plate with its supporting shutter mechanism providing an indication of the low level of clips in the feed chute.

With reference now to FIGS. 1, 2 and 11, it will be noted that an indicator mechanism is provided to indicate when the amount of flat clips in the chute has descended to a preestablished level. As noted in FIGS. 2 and 11, an elongated channel opening 290 is provided in a forward portion of the wall 292 of the chute 36. The weight 56 placed in the chute on the top of the stack of clips includes a laterally extending pin 294. A grooved channel 296 is formed along the inner side of the wall 292 of the chute inwhich the pin 294 normally slides. The channel opening 290 formed in the wall 292 is in communication with the groove 296. As a result, as the weight 58 descends bringing the pin 294 along with it, the pin will ultimately reach the channel opening 290. At that point, the pin will extend through the wall 292.

Placed on the inside of the front plate 152 is a shutter mechanism including a pivot arm 298 pivoted by means of a pin 300 attached to the front plate 152. The arm 290 is free to move between a retracted position, shown in dotted line in FIG. 11 and an indicator position, shown at position 302. Stops 304, 306 are provided to limit the movement between these two positions.

As the arm 294 descends, it begins to engage the cam surface 308 at the rear of the arm 298 moving it downwardly so as to pivot the arm 298 into its upward indicator position 302.

A front frame 310 is provided on the front plate 152 with a transparent section 312 through which the indicator level 298 can be viewed when in its indicating position 302.

Accordingly, as the clips get used up, when the clips reach a lower pre-established level, the pin 294 will cause the indicator arm 298 to move up and become viewed through the front transparent section 312 providing an indication that the amount of clips in the chute have reached a lower level and new clips must be inserted. The transparent sections 312 can be covered with a red hue to facilitate viewing of the indicator. Of course, other types of indicator means can be used including a switch where an alarm will be heard when the lower level is reached. Still other indicator means can be utilized as well.

There has been disclosed heretofore the best embodiment of the invention presently contemplated. However, it is to be understood that various changes and modifications may be made thereto without departing from the spirit of the invention.

I claim:

1. An apparatus for automatic pressure packing of a food casing, comprising:

a yoke assembly having a throat section for slidably retaining therein a neck portion of the casing;

a jaw assembly for grasping a forward end of the casing and pulling the casing through said throat section, said yoke assembly restraining the food behind the throat section to thereby pack the food tightly into the casing;

a feed mechanism for feeding pre-cut flat substantially planar strips through a sequence of operating stations, including a forming station and a crimping station;

a reciprocating forming die descending onto a flat strip positioned at the forming station and bending it into an inverted U-shaped clip;

a reciprocating crimping die operatively coupled to said reciprocating forming die and descending onto a bent clip at the crimping station and carrying said bent clip into said throat section to crimp the bent clip around the casing neck portion being retained in the throat section, said feed mechanism comprising a chute for receiving a stack of said pre-cut flat substantially planar strips, a platform individually receiving thereon said pre-cut flat strips, a reciprocating strip injector for individually injecting the flat strips from said chute onto said platform, and retaining means for slidably retaining said pre-cut flat strips onto said platform, wherein each strip fed onto the platform can transversely move previously fed strips along the platform such that previous strips move a strip into the forming station for forming a bent clip and a formed bent clip is moved by previous flat strips into the crimping station.

2. An apparatus as in claim 1, wherein said yoke assembly comprises a fixed anvil having a notched groove in the upper surface thereof, a clamping head pivotally coupled to said anvil and having a mating notched groove in the lower surface thereof, said mating grooves defining said throat section, and a releasable latch for securing said clamping head into said anvil.

3. An apparatus as in claim 2, wherein the thickness of said anvil is greater than the thickness of said clamping head so as to accommodate into said lower notched groove the descent of said crimping die adjacent said clamping head, and wherein at least a portion of the lower notched groove beneath said crimping die has a substantially "w" shaped cross section to guide the clip into its crimped condition.

4. An apparatus as in claim 1, and comprising a handle means for pivotally operating said clamping head whereby lifting of said handle means automatically releases said latch.

5. An apparatus as in claim 1, wherein said jaw comprises a cylindrical member, a substantially diametrical channel formed across an upper end thereof for receiving therethrough the forward end of the casing, and drive means for rotating said cylindrical member thereby wrapping thereabout a portion of the casing rearward of said forward end to pull the casing through the throat section.

6. An apparatus as in claim 5, wherein said diametrical channel splits an upper portion of said cylindrical member, one side thereof being fixed with respect to said cylindrical member, the other side thereof being rotatingly floating within the confines of said channel, the rotation of said cylindrical member causing said floating side to grasp the forward end of the casing in the channel tightly against the fixed side.

7. An apparatus as in claim 6, wherein the upper end of the channel flares outwardly to define a wider receiving mouth for the forward end of the casing.

8. An apparatus as in claim 6, and comprising a downwardly sloped surface at the bottom of the channel facing in the direction of the forward end of the casing, to facilitate receiving of the casing portion into the channel.

9. An apparatus as in claim 6, wherein the rotation of the cylindrical member is in a direction to initially wrap the casing about said floating side.

10. An apparatus as in claim 1, wherein said retaining means comprise a cover plate removably positioned against said platform, and an upwardly inclined leaf spring projecting from said platform towards said cover plate, said flat strips being retained between said leaf spring and said cover plate.

11. An apparatus as in claim 1, and comprising indicator means associated with the chute for providing an indication of said stack of clips pre-cut flat strips reaching a lower pre-established limit.

12. An apparatus as in claim 11, wherein said indicator means comprises a plug for insertion into said chute onto the stack of flat strips, a pin laterally extending from said plug and slidably received in a channel formed along said chute, said pin descending along said channel as the flat strips are sequentially injected into said platform, an elongated key way formed into said chute at a pre-established height of said chute and in communication with said channel, and a shutter mechanism located adjacent said keyway having a pivoted lever arm operating between a normally retracted position and an activated warning position, whereby said descending pin reaching said keyway operates said shutter mechanism to move said lever into its warning position.

13. An apparatus as in claim 1 and comprising an inverted U-shaped anvil defining a lower bending die and located at the downstream end of said platform, said reciprocating forming die having a recess matingly shaped to said anvil, whereby a flat strips fed onto the platform will move a previously fed flat clip onto said anvil so that descent of the forming die onto the anvil bends the flat clip into an inverted U-shaped clip.

14. An apparatus as in claim 1, wherein said reciprocating crimping die comprises an inverted U-shaped chamber at the lower end of the die, whereby said feed mechanism will move a previously formed inverted U-shaped clip into said chamber, and descent of the crimping die carries the received clip therewith into the throat section.

15. An apparatus as in claim 14, wherein said inverted U-shaped clip comprises outwardly flared legs for spring retention in said chamber.

16. An apparatus as in claim 1, wherein said flat strips comprise downwardly turned distal ends whereby bending into the inverted U-shaped clip causes said ends to be inwardly directed so as to facilitate crimping in said throat, and comprising a pair of lateral gooves forming along said platform to receive the turned ends of said flat strip as said flat strips move therealong.

17. An apparatus as in claim 1, wherein said crimping die comprises a reciprocating driving ram and a sleeve member at least partially surrounding said driving member and reciprocating therewith through the initial descent of the driving ram at the beginning of its reciprocating stroke, and coupling means for slidably interconnecting said sleeve member to said driving ram to permit descent of said driving ram through said sleeve member at the lower end of its stroke.

18. An apparatus as in claim 17, wherein said sleeve member initially extends from the lower end of said driving ram to define a chamber for receiving therein an inverted U-shaped clip, transporting said received clip downward to said throat section upon descent of said driving ram, said throat section having a rim for restraining further descent of said sleeve while said driving ram continues its descent to push the clips from said chamber into said throat section for crimping thereof.

19. An apparatus as in claim 18, wherein the front end of said driving ram is concavely shaped to abut the bight portion of the inverted U-shaped clip.

20. An apparatus as in claim 17, wherein said coupling means comprise an inwardly directed transverse pin extending from said sleeve member, and an elongated channel formed into said driving ram and slidably receiving said pin.

21. An apparatus as in claim 1, and comprising coupling means for connecting said forming die and said crimping die for simultaneous reciprocating action, whereby a flat strip positioned at said forming station is bent simultaneously with the crimping of a bent clip positioned at the crimping station.

22. An apparatus as in claim 21, and comprising a first switch manually operable for triggering and downward stroke of said coupled forming die and crimping die, a second switch automatically triggered by the descending forming die and crimping die to retract the feed mechanism for preparation of feeding a new flat strip, said second switch being automatically reset upon ascent of said coupled dies for feeding of a new flat strip, and a thrid switch automatically triggered by the ascent of said coupled dies for releasing said jaw assembly.

23. An apparatus as in claim 22, and comprising a plurality of air cylinders each coupled to a respective operating part of said apparatus, each air cylinder respectively triggered by a corresponding switch, and coupling means for connecting said air cylinder to a common air supply.

24. An apparatus as in claim 1, and comprising switching means coupled to said clamping head whereby closure of said clamping head causes automatic operation of said jaw assembly.

25. An apparatus as in claim 24, and comprising a reset switch coupled to said reciprocating crimping die, whereupon ascending of said crimping die causes release of said jaw assembly.

26. An apparatus as in claim 25, and comprising a manually operated reset switch for manually releasing said jaw assembly.

27. An apparatus for automatic pressure packing of a food casing comprising:

(a) a clamping assembly for slidably retaining a neck portion of the casing;

(b) a cylindrical member having grasping means for retaining a forward end of the casing;

(c) rotating means for rotating said cylindrical member thereby wrapping thereabout a portion of the casing rearward of said forward end so as to pull a portion of the casing through the clamping assembly and pack the food into the casing;

(d) a substantially diametrical channel formed across an upper end of the cylindrical member for receiving therethrough the forward end of the casing and grasping it as the cylindrical member rotates, the front of the forward end engaging a front edge of the channel and the back of the forward end engaging the rear edge of the channel, said diametrical channel splitting an upper portion of said cylindrical member, one side thereof being fixed with respective to said cylindrical member, the other side thereof being supported by said cylindrical member and rotationally floating within the confines of said channel, the rotation of said cylindrical member causing the back of the forward end of the casing to restrain rotation of the floating side until the front edge of the channel narrows such that is grasps the front of the forward end of the casing whereby the back of the forward end of the casing is wound around the cylindrical member.

28. An apparatus as in claim 27, and comprising a substantially diametrical channel formed across an upper end of the cylindrical member for receiving therethrough the forward end of the casing and grasping it as the cylindrical member rotates.

29. An apparatus as in claim 27, wherein said diametrical channel splits an upper portion of said cylindrical member, one side thereof being fixed with respect to said cylindrical member, the other side thereof being rotationally floating within the confines of said channel, the rotation of said cylindrical member causing said floating side to grasp the forward end of the casing in the channel tightly around the fixed side.

30. An apparatus as in claim 26, wherein the upper end of the channel flares outwardly to define a wider receiving mouth for the forward end of the casing.

31. An apparatus as in claim 27, and comprising a downwardly sloped surface at the bottom of the channel facing in the direction of the forward end of the casing, to facilitate receiving of the casing portion into the channel.

32. An apparatus as in claim 27, wherein the rotation of the cylindrical member is in a direction to initially wrap the casing about said floating side.

33. An apparatus as in claim 27 and comprising means for crimping a clip about the neck portion of the casing.

34. An apparatus for automatic pressure packing of a food casing comprising:

a yoke assembly having a throat section for slidably retaining therein a neck portion of the casing;

a jaw assembly for grasping a forward end of the casing and pulling the casing through said throat section, said yoke assembly restraining the food behind the throat section to thereby pack the food tightly into the casing;

a feed mechanism for feeding flat clips through a sequence of operating stations, including a forming station and a crimping station;

a reciprocating forming die descending onto a flat clip positioned at the forming station and bending it into an inverted U-shaped clip;

a reciprocating crimping die descending onto a bent clip at the crimping station and carrying said bent clip into said throat section to crimp the bent clip around the casing neck portion being retained in the throat section;

a platform individually receiving thereon said flat clips from said feed mechanism;

retaining means for slidably retaining said flat clips onto said platform, whereby each clip fed onto the platform can transversely move previously fed clips along the platform;

a chute for receiving a stack of flat clips;

a reciprocating clip injector for individually injecting flat clips from said chute onto said platform;

indicator means associated with the chute for providing an indication of said stack of clips reaching a lower pre-established limit;

wherein said indicator means comprising a plug for insertion into said chute onto the stack of flat clips, a pin laterally extending from said plug and slidably receiving in a channel formed along said chute, said pin descending along said channel as the flat clips are sequentially injected into said platform, an elongated key way formed into said chute at a pre-established height of said chute and in communication with said channel, and a shutter mechanism located adjacent said keyway having a pivoted lever arm operating between a normally retracted position and an activated warning position, whereby said descending pin reaching said keyway operates said shutter mechanism to move said lever into its warning position.

* * * * *